US006152418A

United States Patent [19]

Panicci

[11] Patent Number: 6,152,418

[45] Date of Patent: Nov. 28, 2000

[54] ADJUSTABLE MOUNTING APPARATUS

[76] Inventor: Richard L. Panicci, 30 Cedar St., Hanover, Mass. 02339

[21] Appl. No.: 09/406,446

[22] Filed: Sep. 27, 1999

Related U.S. Application Data

[60] Provisional application No. 60/105,516, Oct. 26, 1998.

[51] Int. Cl.[7] ..... A47G 1/16

[52] U.S. Cl. ..... 248/496; 248/476; 40/759

[58] Field of Search ..... 248/475.1, 489, 248/495, 496, 477, 480, 476, 225.21; 40/746, 757, 759, 761, 762

[56] References Cited

U.S. PATENT DOCUMENTS

| | | | |
|---|---|---|---|
| 3,265,339 | 8/1966 | Hushok . | |
| 3,861,639 | 1/1975 | Morrill | 248/489 |
| 3,912,216 | 10/1975 | Gano | 248/475 R |
| 4,645,165 | 2/1987 | Raap | 248/476 |
| 4,883,247 | 11/1989 | Crandall | 248/542 |
| 4,892,284 | 1/1990 | Kelrick | 248/476 |
| 5,255,885 | 10/1993 | Iversen | 248/489 |
| 5,444,929 | 8/1995 | Joseloff | 40/759 |
| 5,947,438 | 9/1999 | Lemire | 248/476 |
| 6,003,825 | 12/1999 | Abernathy, Jr. | 248/478 |
| 6,062,525 | 5/2000 | Lemire | 248/475.1 |

FOREIGN PATENT DOCUMENTS

| | | | |
|---|---|---|---|
| 26 09 232 | 9/1977 | Germany | 248/495 |

*Primary Examiner*—Ramon O. Ramirez
*Assistant Examiner*—Jon A Szumny
*Attorney, Agent, or Firm*—Shane H. Hunter, Esq.

[57] ABSTRACT

An apparatus includes a bracket mountable to a surface and including multiple separated fingers extending at least partially transverse to gravitational pull when the bracket is mounted to the surface. A connector is adapted to be received by at least one of the fingers at multiple locations relative to the bracket such that the connector overlaps the at least one finger relative to the gravitational pull, the connector providing a lip directed at least partially transverse to the gravitational pull when the connector is received by the bracket and the bracket is mounted to the surface. A positioner is adapted to adjustably receive an elongated member and to be coupled to the connector overlying a portion of the lip.

20 Claims, 7 Drawing Sheets

ADJUSTABLE MOUNTING APPARATUS

This application claims priority from U.S. Provisional Application 60/105,516, filed on Oct. 26, 1998.

BACKGROUND OF THE INVENTION

The invention relates to apparatus for hanging pictures and the like, and more particularly to apparatus for adjusting the location of pictures and the like.

Objects such as framed pictures are commonly hung on walls as decorations. The pictures are often hung on the walls using hooks mounted to the wall with screws or nails. The picture typically has a mechanism for catching on the hook such as a wire attached to vertical portions of the frame and extending horizontally across the back of the frame, or a bar or loop that can be fitted onto the hook.

The position of the picture can be adjusted in several ways. For example, locating the hook on the wall affects the position of the picture. The position of the wire, bar, or loop on the frame to catch on the hook will affect the position of the picture relative to the hook. The picture's position relative to the hook can also be adjusted by catching the hook with different portions of the wire or bar. This will affect whether the picture is level.

Aligning multiple pictures can be difficult. For example, it is often desirable to have pictures positioned with desired interrelationships, such as having their tops all in a common line. Other patterns are possible such as, multiple pictures with their tops staggered by a consistent amount from one picture to the next. Arranging several pictures can require many adjustments to the positions of one or more of the pictures. This may require, e.g., mounting hooks to the wall in several different places for a picture, adjusting the location a wire attached to a picture's frame, or adjusting which portion of a wire, bar, or loop catches a hook.

SUMMARY OF THE INVENTION

In general, in one aspect, the invention provides an apparatus including a bracket. The bracket is mountable to a surface and includes multiple separated fingers extending at least partially transverse to gravitational pull when the bracket is mounted to the surface. A connector is adapted to be received by at least one of the fingers at multiple locations relative to the bracket such that the connector overlaps the at least one finger relative to the gravitational pull, the connector providing a lip directed at least partially transverse to the gravitational pull when the connector is received by the bracket and the bracket is mounted to the surface. A positioner is adapted to adjustably receive an elongated member and to be coupled to the connector overlying a portion of the lip.

Implementations of the invention can include one or more of the following features. The fingers can be spaced horizontally when the bracket is in the substantially vertical position. The fingers can be separated by first widths and the connector can include a bead chain including portions having second widths smaller than the first widths. The connector can provide a pocket directed at least partially opposite to the gravitational pull when the connector is received by the bracket and the bracket is mounted to the surface, and the positioner can be adapted to be received by the connector pocket.

The fingers can also extend vertically when the connector is received by the bracket and the bracket is mounted to the surface.

The fingers can be spaced vertically when the connector is received by the bracket and the bracket is mounted to the surface. The fingers can extend along a length of the bracket. The fingers can have lengths substantially equal to a length of the bracket. The bracket can have a substantially multiple-J-shaped cross section. The fingers can also be spaced horizontally when the connector is received by the bracket and the bracket is mounted to the surface. The bracket can include a plate from which the fingers extend and the fingers can include posts with enlarged portions displaced from the plate. The connector can include a plurality of posts with enlarged ends.

The elongated member can be a wire and the positioner can include a material adapted to produce a coefficient of friction between the received wire and the positioner to substantially inhibit movement of the wire relative to the positioner. The positioner material can include an elastomer. The positioner can include a recess having a width approximately equal to a width of the connector pocket.

In general, in another aspect, the invention provides an apparatus for hanging an object such as a picture or the like. A member is mountable to a substantially vertical surface and is adapted to receive a connector at multiple horizontal locations when mounted to the substantially vertical surface. A connector is adapted to couple to the member at a desired one of the multiple horizontal locations and includes a hook portion that provides a pocket that is at least partially upwardly-directed and disposed at a selected one of multiple vertical positions when the connector is coupled to the member. A positioner is adapted to adjustably receive a wire and to be received by the upwardly-directed pocket of the connector.

Implementations of the invention can include one or more of the following features. The positioner can provide an opening through the positioner of a diameter smaller than a diameter of the wire before the elongated member is received by the positioner. The positioner can provide a passageway for the wire from the opening to an exterior of the positioner such that the wire can be received into the opening through the passageway. A portion of the positioner that provides the opening includes a material adapted to frictionally engage the wire to substantially prevent movement of the positioner relative to the wire when the wire is received by the opening and the positioner is received by the connector pocket and the wire is supporting the picture or the like.

In general, in another aspect, the invention provides an apparatus for hanging an object such as a picture or the like. A bracket is mountable in a substantially vertical position. First means are provided for coupling a hook to the bracket in a plurality of horizontal and vertical positions relative to the bracket when the bracket is in the substantially vertical position. Second means are provided for adjustably receiving an elongated member and for coupling to the hook such that the second means is substantially prevented from moving relative to the elongated member when the second means is coupled to the hook and the elongated member is supporting the frame or the like.

Various aspects of the invention may provide one or more of the following advantages. An object's position relative to, e.g., a wall or its boundaries, can be readily adjusted in two dimensions. For example, a picture's horizontal and/or vertical position on a substantially vertical wall can be adjusted. An object's position can be independently adjusted along two axes. For example, a picture's horizontal and vertical position on a substantially vertical wall can be adjusted independently of each other. Multiple objects can be arranged into a desired spatial relationship without modifying or adjusting mechanisms fixedly attached to the object. The angular orientation (levelness, or tilt) of an object relative to the horizon can be easily adjusted with repeated adjustment reduced in frequency or obviated and changes in angular orientation inhibited once the object is mounted to the wall.

DESCRIPTION OF PREFERRED EMBODIMENTS

The invention provides apparatus for mounting objects, especially mounting pictures or other framed decorations or the like to substantially vertical walls. Using the invention, an object's position can be easily adjusted relative to the wall. Thus, multiple objects' positions can be adjusted to achieve a desired relationship among the objects, such as having the tops of the objects aligned. Also, once an object is adjusted such that the object is oriented at a desired angle, e.g., such that the object is leveled, relative to, e.g., the horizon. The object can be repositioned without having to readjust the angular orientation of the object.

Figure 1:
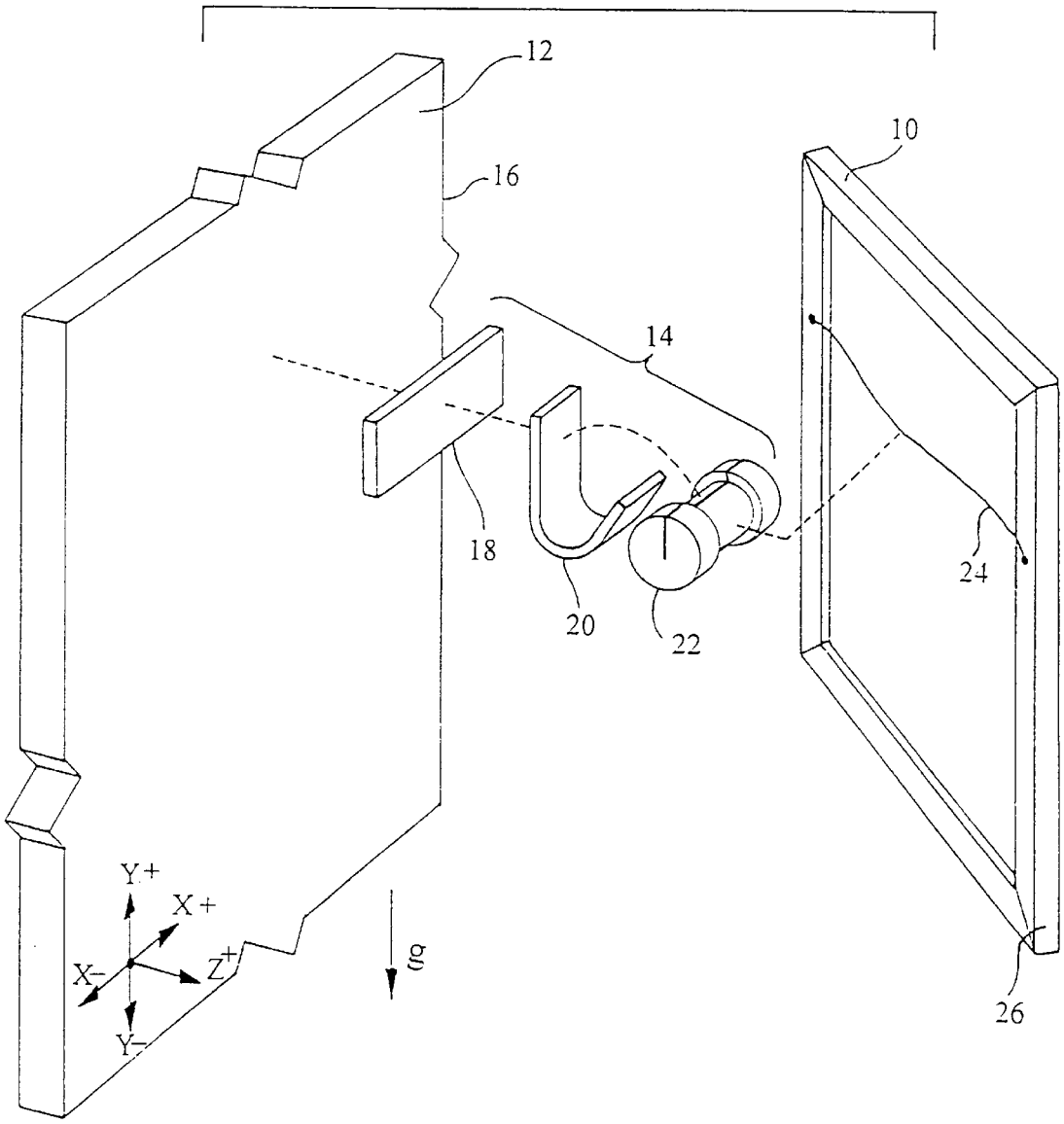
FIG. 1 is a simplified exploded view of a system for mounting an object including the object, a wall, and a mounting apparatus.

As shown in FIG. 1, an object 10 can be mounted to a surface 12 using a mounting apparatus 14. Here, the surface 12 is of a vertical wall 16, and the object 10 is a framed picture, the back of which is shown. For reference, an x-y-z coordinate system is shown, with the y direction being vertical in the plane of the wall 16, the x direction being horizontal in the plane of the wall 16, and the z direction being horizontal and transverse to the plane of the wall 16. The mounting apparatus 14 is shown in simplified form to include a bracket 18, a connector 20, and a positioner 22. Various forms of the apparatus 14 are possible, with examples provided below. In each example provided, the bracket 18 is adapted to mount to the surface 12 and is shown as though mounted to vertical surface 12, although surface 12 is not shown except in FIG. 1. Also, the connector 20 is adapted to selectively couple to the bracket 18 at various locations relative to the bracket 18. The positioner 22 is adapted to be received by the connector 20 and to receive a wire 24 attached to the object 10, here a frame 26 of the picture.

In each of the various figures, brackets, connectors, and positioners are each identified with reference designators ending in "18," "20," and "22," respectively, and are collectively identified with designators ending in "14." Other reference designators with identical final two digits do not necessarily represent similar members.

Figure 2:
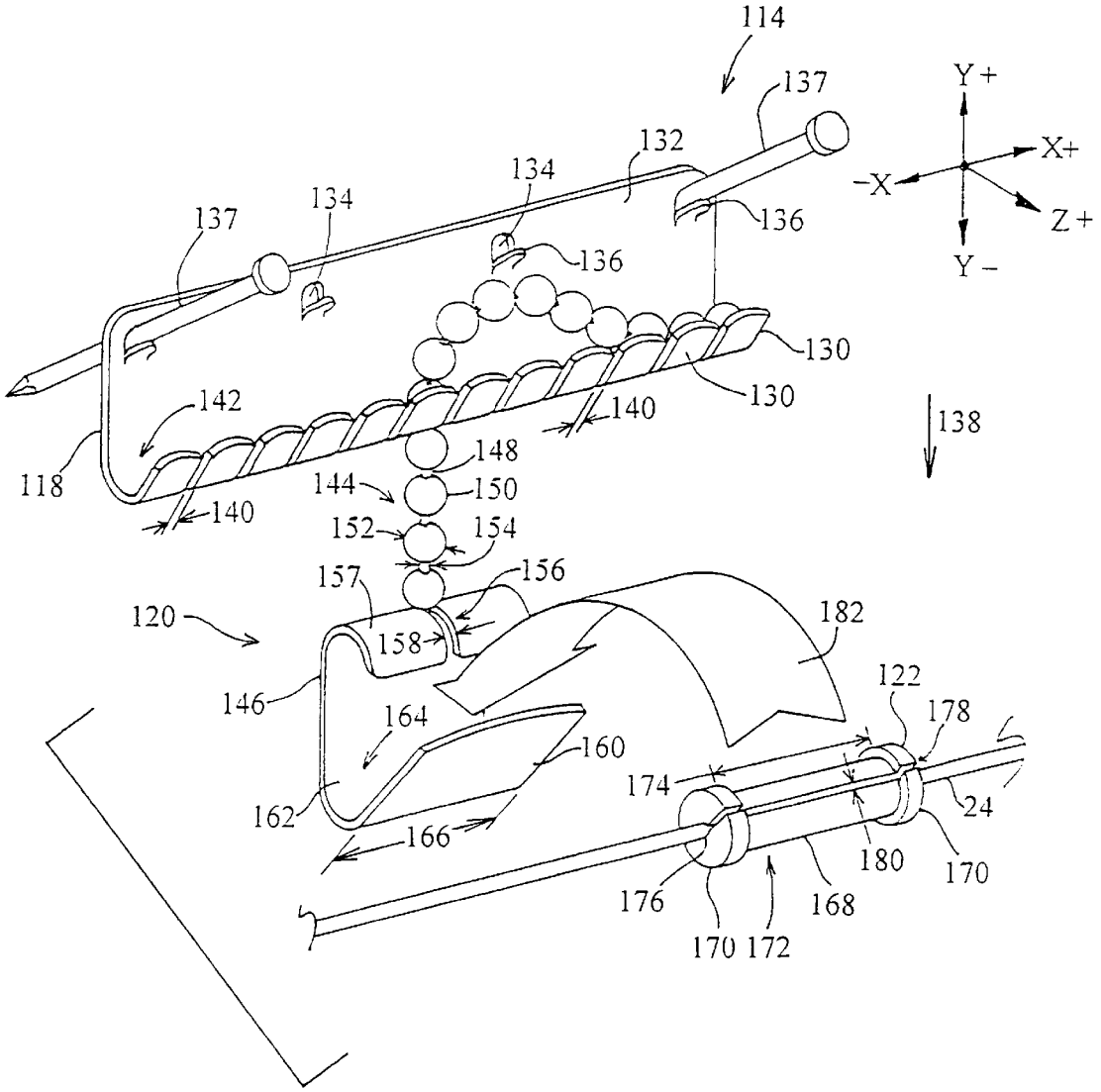
FIG. 2 is a perspective view of a first embodiment of a mounting apparatus including a bracket, a connector, and a positioned

As shown in FIG. 2, a mounting apparatus 114 includes a bracket 118, a connector 120, and a positioner 122.

The bracket 118 can be made of a variety of materials, such as metal (e.g., steel) or a polymer, to provide the strength to support the object 10 (FIG. 1), and includes fingers 130 and a plate 132. Portions of plate 132 are formed (e.g., bent) to provide openings 134 and flaps 136. The openings 134 permit the insertion of, and flaps 136 help to guide and support, nails 137 for attaching the bracket 118 to the surface 12 (FIG. 1). Other attaching means could be used, such as screws, adhesives, etc., for mounting the bracket 118 to the surface 12. When the bracket 118 is mounted to surface 12, the fingers 130 extend at least partially in the z direction transverse to a direction of gravitational pull, g, as indicated by arrow 138 (i.e., the negative-y direction). As shown, the fingers 130 also extend partially in the direction opposite to the gravitational pull g (i.e., the positively direction), giving the bracket 118 a J shape. The fingers 130 are horizontally spaced in the x direction, being separated by distances or widths 140. The fingers 130 are disposed and extend along a length of the bracket 118 in the x direction. The plate 132 and fingers 130 provide a trough 142 along the length of the bracket 118.

The connector 120 includes a bead chain 144 adapted to be received by the bracket trough 142, and a hook 146. The bead chain 144 is an elongated member with enlarged portions disposed along its length. As shown, the bead chain 144 is a series of short cylindrical metal links 148 with heads (not shown) at their ends inside beads 150 to retain the beads 150 on the links 148. The beads 150 can swivel and rotate about the links 148. Both the links 148 and beads 150 can be made, e.g., of steel. Although the links 148 are shown as being cylindrical and the beads 150 shown as spheres, other shapes for both the links 148 and the beads 150 are acceptable. The beads 150 have widths or diameters 152 that are larger than the widths 140 separating the bracket fingers 130. Exposed portions of the links 148 between the beads 150 have widths or diameters 154 that are smaller than the widths 140 separating the bracket fingers 130.

The hook 146 includes an upper lip 157 that provides a notch 156 to receive the bead chain 144, and a lower lip 160. A width 158 of the notch 156 is larger than the width 154 of the links 148 and smaller than the width 152 of the beads 150. The lower lip 160 extends from a body 162 partially transverse to gravity in the z direction and partially opposite gravity in the positively direction. A width 166 of the lower lip 160 traverses the width of the hook 146. A pocket 164 is provided by the lower lip 160 and the body 162. Note that the pocket 164 is not enclosed in the x direction at the ends of the hook 146. This pocket 164 is partially upwardly directed (in the positively direction) when the connector 120 is received by the bracket. 118 which is mounted to the surface 12 (FIG. 1).

The positioner 122 is adapted to be received by the pocket 164 and includes a body 168 and two discs 170. As shown, the body 168 and discs 170 are both substantially cylindrically shaped and integrally formed. Because the body 168 has a smaller diameter than the discs 170, the positioner provides a recess 172 of a width 174 defined by the spacing of the discs 170. This width 174 is approximately the same as the width 166 of the lower lip 160. An axial opening 176 is provided in the discs 170 and the body 168 and is sized to receive the wire 24. Preferably, the opening 176 has a diameter smaller than a diameter of the wire 24. A radial discontinuity 178 is provided along the length of the positioner 122 from the opening 176 to the outer surface of the positioner 122. A width 180 of this discontinuity 178 is preferably nonzero, but smaller than the diameter of the wire 24 when the wire 24 is not received by the opening 176.

The positioner 122 is made of a resilient material, e.g., an elastomer that allows the width 180 of the discontinuity 178 and the diameter of the opening 176 to expand. This material also preferably provides a sufficient coefficient of static friction between the positioner 122 and the wire 24, when the wire 24 is received by the opening 176 and a force due to the weight of the object 10 is exerted on the positioner 122 by the wire 24, to substantially inhibit the wire 24 from moving relative to the positioner 122. Thus, the positioner 122 is inhibited from sliding along or rotating around the wire 24 under these conditions due to typical occurrences that might otherwise cause such sliding or rotation such as sound vibrations or a person bumping into surface 12.

To assemble the apparatus 114, the bead chain 144 is attached to the hook 146. The bead chain 144 can be removably attached to the hook 146, e.g., by sliding a portion of the bead chain 144 exposed between beads 150 into the notch 156. The bead chain 144 can further be fixedly attached to the hook 146, e.g., by gluing, soldering, or welding the bead chain 144 to the hook 146.

In operation, the location of the connector pocket 164, and thus of the picture 10 (FIG. 1) to be mounted, can be adjusted in two dimensions. The bracket 118 is mounted, e.g., nailed, to the surface 12 (FIG. 1). The connector 120 is connected to the bracket 118 by inserting an exposed portion of a link 148 between a pair of fingers 130. Once the connector 120 is received by the bracket 118, portions of a bead 150 overlap portions of two fingers 130 relative to the gravitational pull. By selecting between which pair of fingers 130 to insert the bead chain 144, the horizontal or x-direction position of the connector pocket 164 can be selected/adjusted. Also, by selecting which link 148 to insert between fingers 130, the vertical or y-direction position of the connector pocket 164 can be selected/adjusted.

The angular orientation of the picture 10 (FIG. 1) can be adjusted using the positioner 122. The positioner 122 receives the wire 24 by inserting the wire 24 through the discontinuity 178 and into the opening 176. The positioner 122 is slid along the wire 24 to a selected position, rotated such that the discontinuity is directed at least partially upward (to help retain the wire 24 in the opening 176), and is placed into/received by the pocket 164 as indicated by arrow 182. The position of the positioner 122 affects the weight distribution of the picture 10 relative to the positioner 122. Thus, the angular orientation (primarily in the x-y plane or a plane parallel thereto, but also to some extent the y-z plane due to, e.g., the wire 24 being longer than the inner width of the frame 26) of the picture 10 is affected by the location of the positioner 122 along the wire 24 relative to the picture 10. Thus, the angular orientation of the picture 10, relative to the edges or corners of the surface 12 (FIG. 1), and/or the horizon, can be adjusted by sliding the positioner along the wire 24. The discs 176 help prevent the positioner 122 from moving relative to the hook 146 and the friction between the positioner 122 and the wire 24 helps prevent the wire 24 from moving relative to the positioner 122. This helps prevent the angular orientation of the picture 10 from changing due to, e.g., vibrations to the picture 10.

Figure 3:
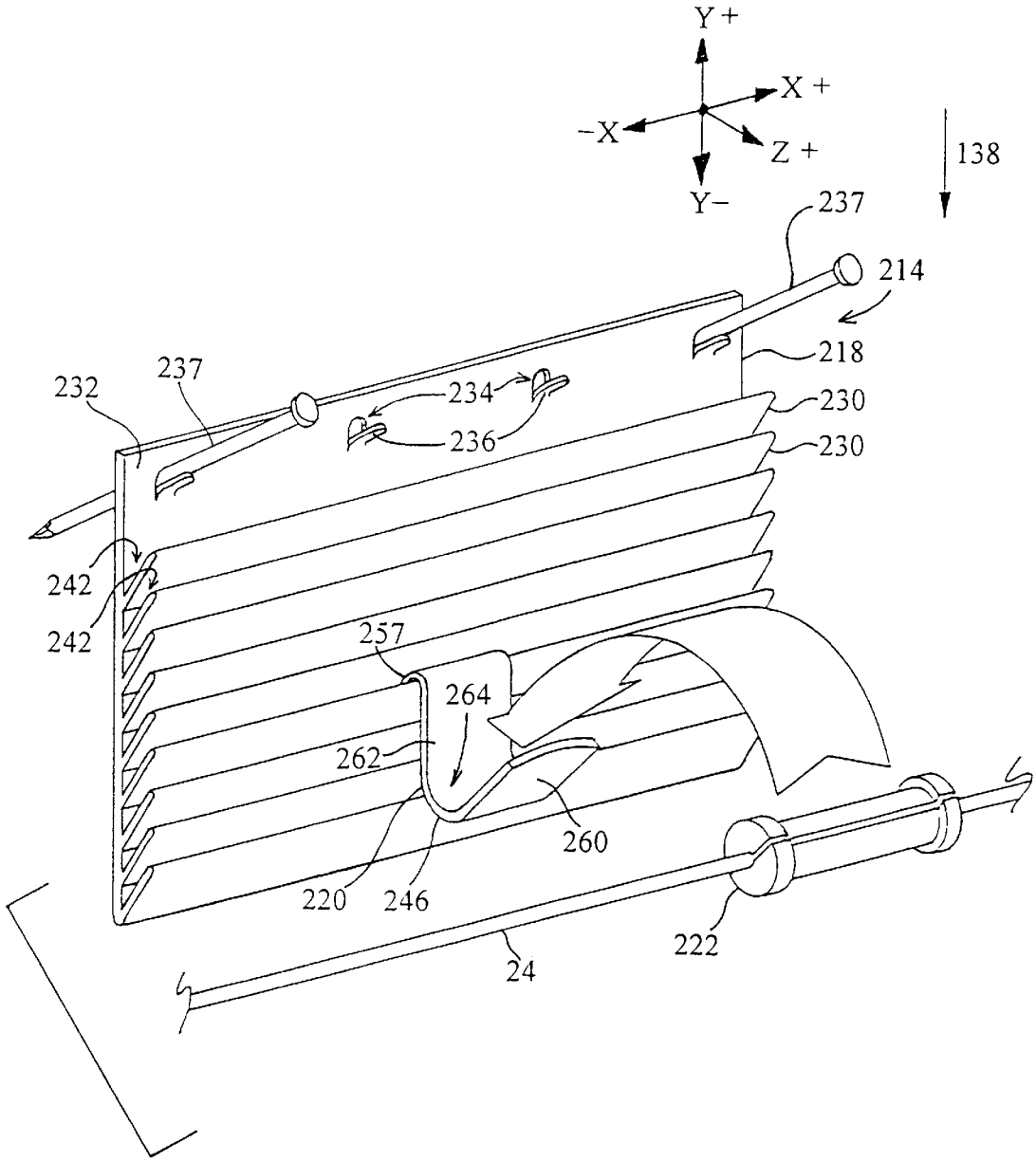
FIG. 3 is a perspective view of a second embodiment of a mounting apparatus including a bracket, a connector, and a positioner.

As shown in FIG. 3, a mounting apparatus 214 includes a bracket 218, a connector 220, and a positioner 222. The positioner 222 is the same as the positioner 122 shown in FIG. 2. As with the embodiment shown in FIG. 1, the bracket 218 and connector 220 can be made of, metal (e.g., steel), and the positioner 222 made of, e.g., an elastomer.

The bracket 218 includes fingers 230 and a plate 232. Portions of plate 232 are formed to provide openings 234 and flaps 236 for receiving and guiding attaching means such as nails 237. As shown, the fingers 230 extend both partially transverse to, in the z direction, and partially opposite to, in the positively direction, the gravitational pull g indicated by arrow 138. The fingers 230, as shown, have lengths that extend the entire length of the bracket 218 along the x axis. The fingers 230 are vertically spaced in the y direction, giving the bracket 218 a substantially multiple-J-shaped cross section. The plate 232 and fingers 230 provide troughs 242 along the length of the bracket 218.

The connector 220 is a hook 246 including an upper lip 257 configured to be received by the bracket troughs 242 (and overlap with the fingers 230), a body 262, and a lower lip 260. The body 262 and lower lip 260 are similar to the body 162 and lower lip 160 of the hook 146 (FIG. 2). The body 262 and lower lip 260 provide a partially-upwardly-directed pocket 264 for receiving the positioner 222, which is similar to the positioner 122 (FIG. 2).

In operation of the embodiment shown in FIG. 3 the location of the connector pocket 164, and thus of the picture 10 (FIG. 1) to be mounted, and the angular orientation of the picture 10 can be adjusted. The bracket 218 is mounted, e.g., nailed, to the surface 12 (FIG. 1). The connector 220 is connected to the bracket 218 by inserting the upper lip 257 of the connector 220 between a pair of fingers 230 into one of the troughs 242. By selecting where along the width of the trough 242 to insert the upper lip 257, the horizontal or x-direction position of the connector pocket 264 can be selected/adjusted. Also, by selecting in which trough 242 to insert the upper lip 257 of the connector 220, the vertical or y-direction position of the connector pocket 264 can be selected/adjusted. The angular orientation of the picture 10 can be adjusted as described above with respect to the embodiment shown in FIG. 2.

Figure 4:
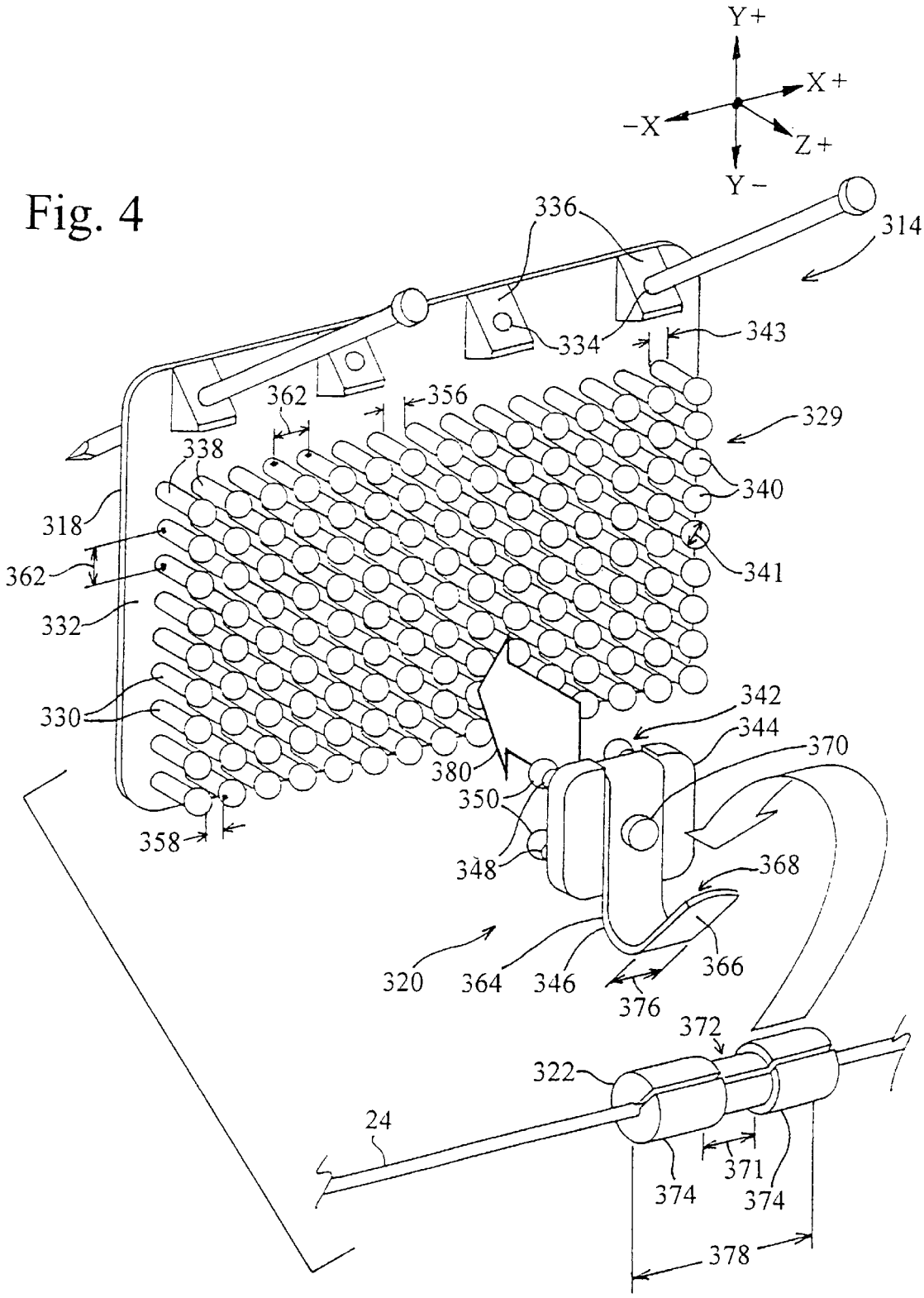
FIG. 4 is a perspective view of a third embodiment of a mounting apparatus including a bracket, a connector, and a positioner.

As shown in FIG. 4, a mounting apparatus 314 includes a bracket 318, a connector 320, and a positioner 322.

The bracket 318 includes an array 329 of fingers 330 and a plate 332. Guides 336 include angled openings 334 for guiding attaching means, such as nails 337, through the bracket 318 and into the wall 16 (FIG. 1). As shown, the array 329 is a two-dimensional array 329 of fingers 330 disposed horizontally and vertically. The fingers 330 are both vertically spaced in the y direction and horizontally spaced in the x direction. The fingers 330 are adapted to flex to receive similarly-shaped fingers. Also as shown, the fingers 330 have cylindrical posts 338 that extend transverse to the gravitational pull g in the z direction, and enlarged spherical ends 340 having diameters 341 larger than the diameters 343 of the posts 338.

Figure 5:
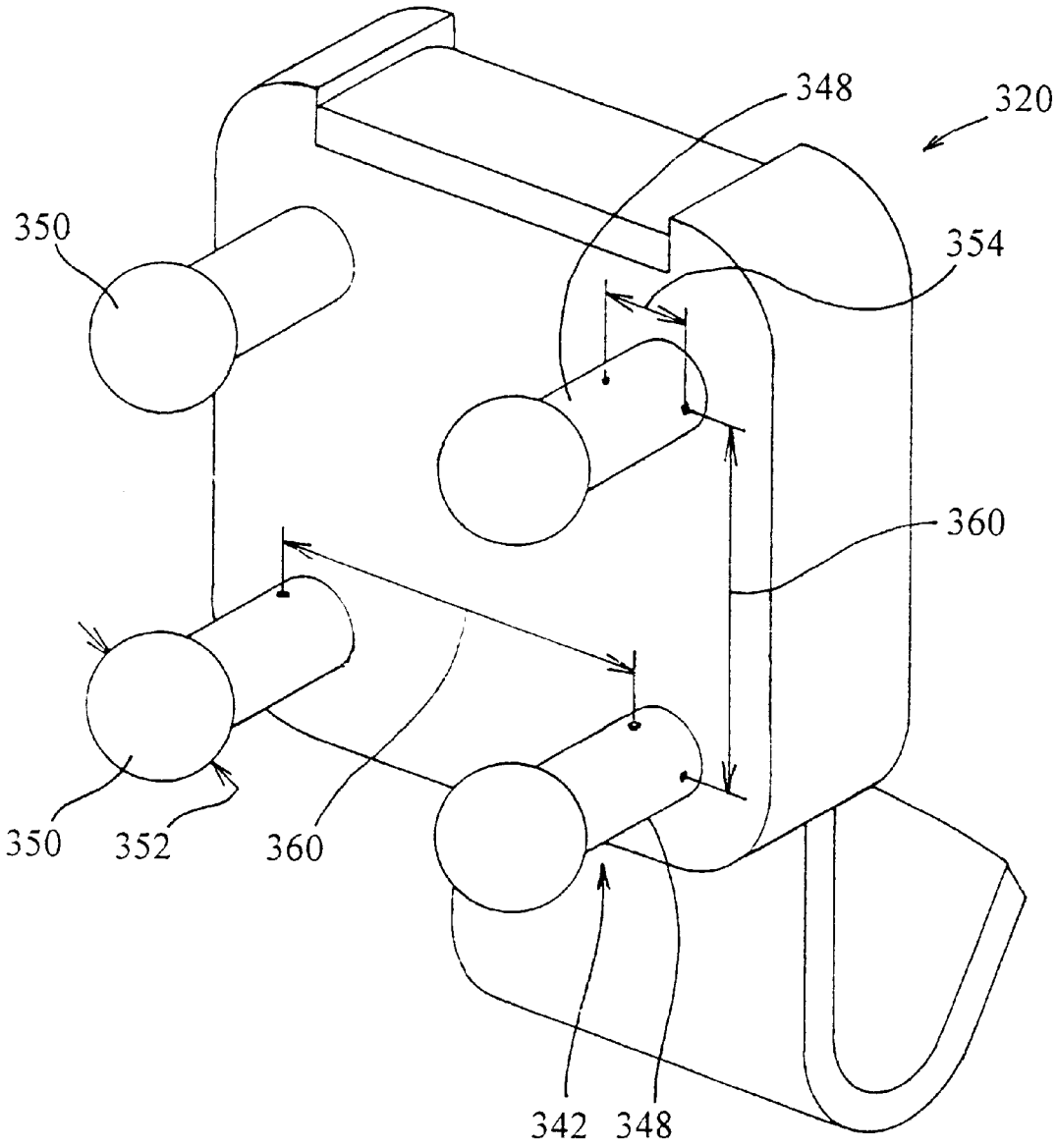
FIG. 5 is perspective view of the connector shown in FIG. 4.

Referring also to FIG. 5, a connector 320 includes several, here four (three shown in FIG. 4), connector fingers 342, configured to be received by the bracket fingers 330, a plate 344, and a hook 346. The fingers 342 are configured to flex and the connector 320 could have as few as one connector finger 342. As with the bracket fingers 330, the connector fingers 342 have cylindrical posts 348 and enlarged spherical ends 350 having diameters 354 smaller than diameters 352, respectively. The connector finger diameters 352 and 354 are larger than horizontal (x direction) separations 356 and 358 of the posts 338 and enlarged ends 340, respectively. Thus, when the connector 320 is received by the bracket 318 the enlarged ends 350 and/or posts 348 of the connector fingers 342 rest on and are supported by a pair of underlying posts 338 and/or enlarged ends 340 of the bracket fingers 330. The connector fingers 342 have center-to-center spacings 360 that are substantially the same in the vertical (y) and horizontal (x) directions. The bracket fingers 330 have center-to-center spacings 362 that are substantially the same in the vertical (y) and horizontal (x) directions. The spacings 360 and 362 may be different from each other but are selected such that the fingers 342 fit into alternating openings between sets of four bracket fingers 330. In other words, the center-to-center vertical and horizontal spacings 360 of connector fingers 342 are about twice the center-to-center vertical and horizontal spacings 362 of bracket fingers 330. This helps allow the bracket fingers 330 to flex to accommodate the connector fingers 342 when the connector 320 is inserted into the bracket 318. With the connector 320 received by the bracket 318, the fingers 342 extend horizontally in the negative z direction (i.e., opposite to the positive z direction). When in this position, a body 364 and a lip 366 of the hook 346 provide an at least partially upwardly-directed pocket 368. The hook 346 is fixedly attached to the plate 344, e.g., with a rivet 370 that may be a plastic stud that has been heated to form a retaining end.

The positioner 322 is similar to the positioner 122 shown in FIG. 2. A width 371 of a recess 372 provided by the positioner 322 between discs 374 is adapted to be approximately the same as a width 376 of the connector pocket 368. As shown, the width 371 is smaller than the width 166 of the connector pocket 164 shown in FIG. 2, although this is not required. For each embodiment of the invention, the positioner is made to mate with (i.e., be receivable by) the corresponding hook. An overall length 378 of the positioner 322 can be the same as that of the positioner 122 (FIG. 2), if, as shown, the discs 374 are wider than the discs 170 (FIG. 2). It is desirable to provide wider discs 374 so that the positioner 322 can provide adequate frictional resistance with respect to the wire 24 to inhibit motion relative to the wire 24.

The fingers 330 and the connector fingers 342 are formed by injection molding and heating. A polymer is injection molded to form cylindrical posts. Heating the ends of these posts by bringing a heat source near the posts melts the ends to form the enlarged ends, thus forming the fingers 330 and 342. The plates 322 and 344 are made of the same polymer as the fingers 330 and 342. Other techniques could be used to the form the fingers 330 and 342.

In operation of the embodiment shown in FIGS. 4 and 5 the location of the connector pocket 368, and thus of the picture 10 (FIG. 1) to be mounted, and the angular orientation of the picture 10 can be adjusted. The bracket 318 is mounted, e.g., nailed, to the surface 12 (FIG. 1). The connector 320 is connected to the bracket 318 by inserting the connector fingers 342 into meshing relationship with the bracket fingers 330 as indicated by arrow 380. The fingers 330 can flex to allow this meshing. Once the connector 320 is inserted, preferably each connector finger 342 contacts, is supported by, and is restrained horizontally (in the z direction) by two underlying bracket posts 338 and possibly two posts 338 above each finger 342. The horizontal (x direction) and vertical (y direction) position of the connector 320 is selected/adjusted by meshing the connector fingers 342 with the bracket fingers 330 at a desired location in the array 329. The angular orientation of the picture 10 (FIG. 1) can be adjusted as described above with respect to the embodiment shown in FIG. 2.

Figure 6:
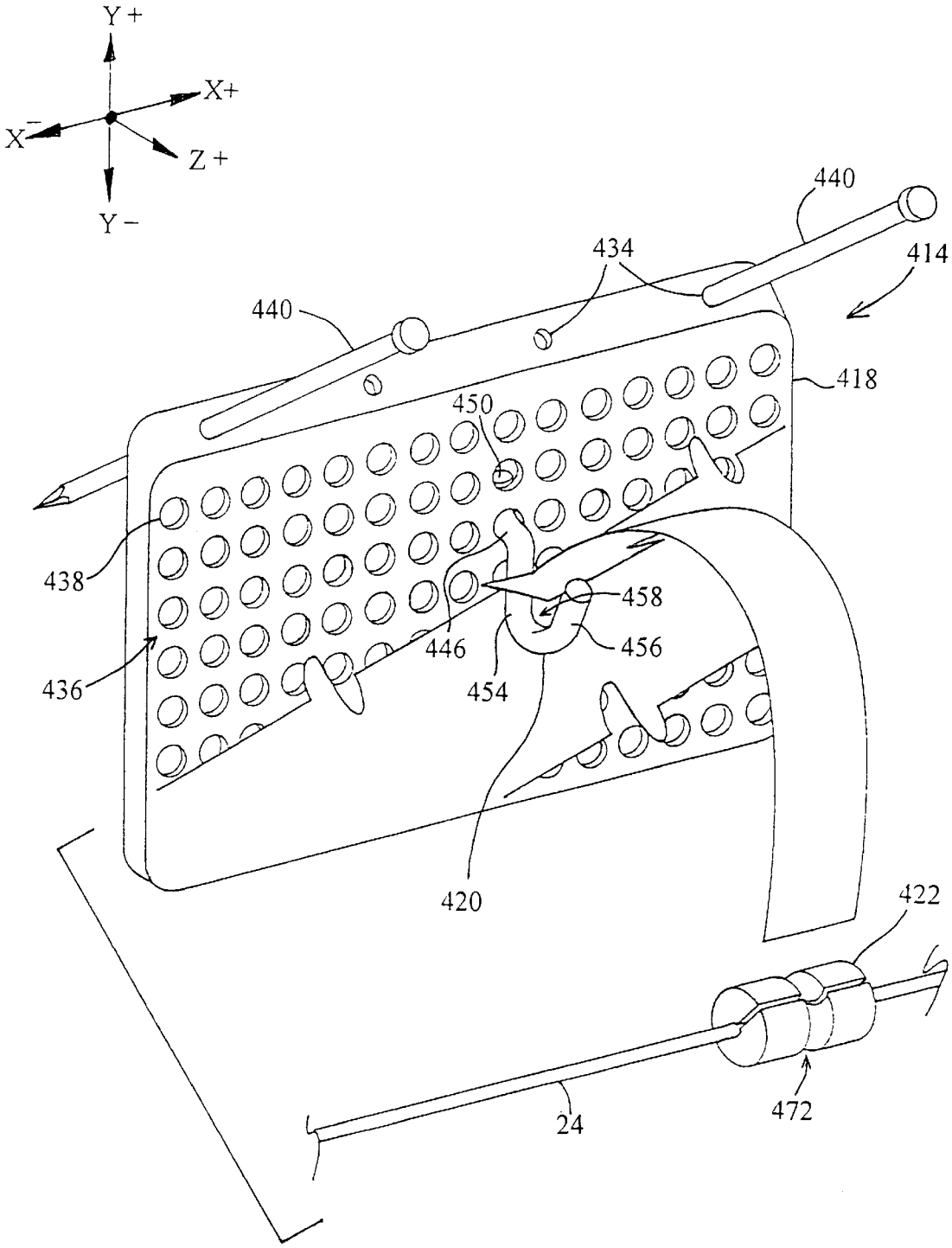
FIG. 6 is a perspective view of a fourth embodiment of a mounting apparatus including a bracket, a connector, and a positioner.

As shown in FIG. 6, a mounting apparatus 414 includes a bracket 418, a connector 420, and a positioner 422. As before, the bracket 418 and connector 420 can be made of, e.g., steel or a polymer, and the positioner 422 made of, e.g., an elastomer.

The bracket 418 includes a plate 432 with several angled openings 434 and an array 436 of holes 438. Angled openings 434 provide guides for attaching means, such as nails 440. As shown, the array 436 is a two-dimensional array of holes 438 disposed horizontally and vertically (parallel to the x and y axes). The holes 438 are both vertically spaced in the y direction and horizontally spaced in the x direction.

Figure 7:
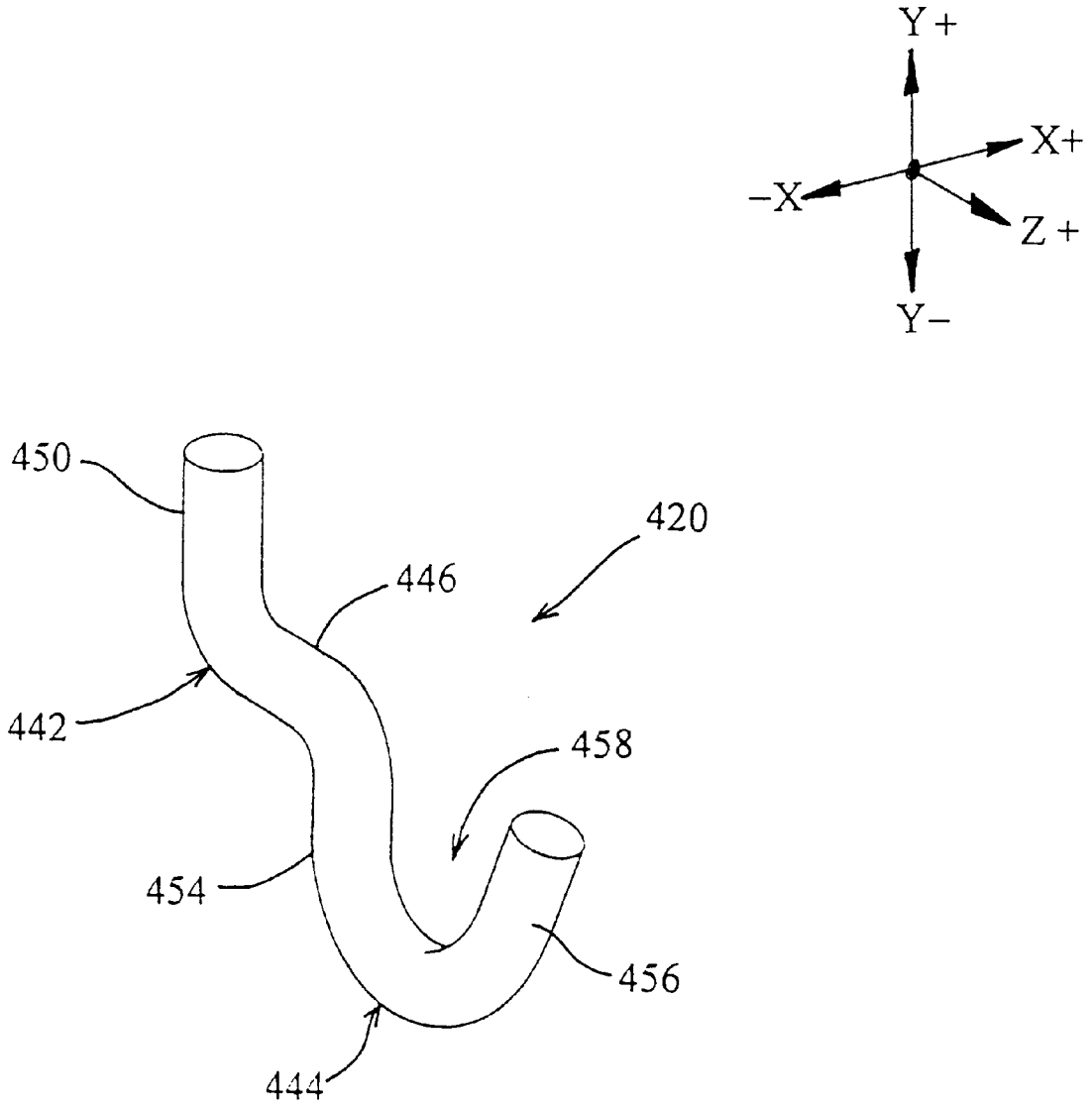
FIG. 7 is a perspective view of the connector shown in FIG. 6.

Referring also to FIG. 7, the connector 420 includes a bend 442 and a hook 444. The bend 442 is configured such that when a lower shaft 446 is disposed through a hole 438, an upper shaft 450 is disposed along the back of the bracket 418 (as shown in FIG. 6). The hook 444 is cylindrically shaped with a body 454 and lip 456 providing a partially-upwardly-directed pocket 458 when received by the bracket 418 as shown in FIG. 6.

The positioner 422 is similar to the positioner 322 shown in FIG. 4. In this case, however, a recess 472 is partially cylindrical, with a radius approximately equal to that of the hook 444. This shape of the recess 472 helps to prevent movement of the positioner 422 relative to the connector 420 when the positioner 422 is received by the pocket 458.

In operation of the embodiment shown in FIGS. 6 and 7 the location of the connector pocket 458, and thus of the picture 10 (FIG. 1) to be mounted, and the angular orientation of the picture 10 can be adjusted. The bracket 418 is mounted, e.g., nailed, to the surface 12 (FIG. 1). The connector 420 is connected to the bracket 418 by inserting the bend 442 into a selected one of the holes 438 such that the pocket 458 is at least partially upwardly directed as shown in FIG. 6. The horizontal and vertical position of the connector 420 is selected/adjusted by selecting a desired hole 438 in the array 436 in which to insert the connector 420. The angular orientation of the picture 10 (FIG. 1) can be adjusted as described above with respect to the embodiment shown in FIG. 2.

Other embodiments are within the scope of the appended claims. The surface 12 to which the bracket 18 is mounted need not be vertical. Also, the bracket 18 need not be directly mounted to or in contact with the surface 12 to which it is mounted. For example, the bracket 18 can be attached to the surface 12 with wires or the like. The surface 12 to which the bracket 18 is mounted can be a combination of separate surfaces 12, and the surfaces 12 can be very small. The wire 24 can be any of a variety of elongated members and need not specifically be a single metal element or plurality of wound metal elements. For example, the wire 24 could be twine.

The positioner 22 need not be cylindrical. Any of a variety of shapes can be used to provide a recess or other opening for receiving, or being received by, the connector 20. With these different shapes, as with those shown in FIGS. 1–4, and 6 the positioner can be configured to conform to the hook pocket. Any positioner can be used with any hook if the widths and shapes of the positioner and hook allow the positioner to be received by the hook.

What is claimed is:

1. An apparatus comprising:

a bracket adapted to be mounted to a surface and including a plurality of separated fingers extending at least partially transverse to gravitational pull when the bracket is mounted to the surface;

a connector adapted to be received by at least one of the fingers at a plurality of locations relative to the bracket such that the connector overlaps the at least one finger relative to the gravitational pull, the connector providing a lip directed at least partially transverse to the gravitational pull when the connector is received by the bracket and the bracket is mounted to the surface; and a positioner adapted to adjustably receive an elongated member and to be coupled to the connector overlying a portion of the lip.

2. The apparatus of claim 1 wherein the fingers are spaced horizontally when the bracket is in the substantially vertical position.

3. The apparatus of claim 2 wherein the fingers are separated by first widths and the connector comprises a bead chain including portions having second widths smaller than the first widths.

4. The apparatus of claim 3 wherein the connector provides a pocket directed at least partially opposite to the gravitational pull when the connector is received by the bracket and the bracket is mounted to the surface, and wherein the positioner is adapted to be received by the connector pocket.

5. The apparatus of claim 1 wherein the fingers also extend vertically when the connector is received by the bracket and the bracket is mounted to the surface.

6. The apparatus of claim 1 wherein the fingers are spaced vertically when the connector is received by the bracket and the bracket is mounted to the surface.

7. The apparatus of claim 6 wherein the fingers extend along a length of the bracket.

8. The apparatus of claim 7 wherein the fingers have lengths substantially equal to a length of the bracket.

9. The apparatus of claim 6 wherein the bracket has a substantially multiple-J-shaped cross section.

10. The apparatus of claim 6 wherein the fingers are also spaced horizontally when the connector is received by the bracket and the bracket is mounted to the surface.

11. The apparatus of claim 10 wherein the bracket includes a plate from which the fingers extend and the fingers include posts with enlarged portions displaced from the plate.

12. The apparatus of claim 11 wherein the connector includes a plurality of posts with enlarged ends.

13. The apparatus of claim 1 wherein the elongated member is a wire and the positioner comprises a material adapted to produce a coefficient of friction between the received wire and the positioner to substantially inhibit movement of the wire relative to the positioner.

14. The apparatus of claim 13 wherein the positioner material comprises an elastomer.

15. The apparatus of claim 13 wherein the positioner includes a recess having a width approximately equal to a width of the connector pocket.

16. An apparatus for hanging an object such as a picture, the apparatus comprising:

a member adapted to be mounted to a substantially vertical surface and receiving a connector at a plurality of horizontal locations when mounted to the substantially vertical surface;

the connector is adapted to couple to the member at a desired one of the plurality of horizontal locations and includes a hook portion that provides a pocket that is at least partially upwardly-directed and disposed at a selected one of a plurality of vertical positions when the connector is coupled to the member; and a positioner adapted to adjustably receive a wire and to be received by the upwardly-directed pocket of the connector.

17. The apparatus of claim 16 wherein the positioner provides an opening through the positioner of a diameter smaller than a diameter of the wire before the elongated member is received by the positioner.

18. The apparatus of claim 17 wherein the positioner provides a passageway for the wire from the opening to an exterior of the positioner such that the wire can be received into the opening through the passageway.

19. The apparatus of claim 18 wherein a portion of the positioner providing the opening comprises a material adapted to frictionally engage the wire to substantially prevent movement of the positioner relative to the wire when the wire is received by the opening and the positioner is received by the connector pocket and the wire is supporting the picture.

20. An apparatus for hanging an object such as a picture, the apparatus comprising:

a bracket adapted in a substantially vertical position;

first means for coupling a hook to the bracket in a plurality of horizontal and vertical positions relative to the bracket when the bracket is in the substantially vertical position;

second means for adjustably receiving an elongated member and for coupling to the hook such that the second means is substantially prevented from moving relative to the elongated member when the second means is coupled to the hook and the elongated member is supporting the picture.

* * * * *